US005904613A

United States Patent [19]

Luderich

[11] Patent Number: 5,904,613

[45] Date of Patent: May 18, 1999

[54] ADDITIONAL, FRICTION-WHEEL-DRIVEN GRINDING SPINDLE FOR BEVELLING THE EDGES OF SPECTACLE LENSES ON A SPECTACLE-LENS-EDGING MACHINE

[75] Inventor: Jörg Luderich, Leverkusen, Germany

[73] Assignee: Wernicke & Co. GmbH, Germany

[21] Appl. No.: 08/957,178

[22] Filed: Oct. 24, 1997

[30] Foreign Application Priority Data

Oct. 24, 1996 [DE] Germany ..... 196 43 546

[51] Int. Cl.[6] ..... B24B 5/00

[52] U.S. Cl. ..... 451/255; 451/43; 451/65

[58] Field of Search ..... 451/43, 44, 57, 451/65

[56] References Cited

U.S. PATENT DOCUMENTS

| | | | |
|---|---|---|---|
| 5,056,270 | 10/1991 | Curcher | 51/284 |
| 5,363,597 | 11/1994 | Gottschald et al. | 451/43 |
| 5,630,746 | 5/1997 | Gottschald et al. | 451/43 |

*Primary Examiner*—Timothy V. Eley
*Assistant Examiner*—Benjamin M. Halpern
*Attorney, Agent, or Firm*—Ostrolenk, Faber, Gerb & Soffen, LLP

[57] ABSTRACT

A spectacle lens edging machine which supports a lens for rotation on coaxial half shafts, a grinding spindle with an axis parallel to the lens shafts, the grinding spindle is movable radially and axially relative to the shafts and has a grinding wheel thereon for grinding the periphery of a lens. An additional friction wheel driven grinding spindle for beveling the edges of the spectacle lens arranged on the bearing housing for the spindle and so moves radially and axially with the spindle. The grinding tool rotates on an axis extending radially to the axis of the spectacle lens and to the grinding spindle. An angular drive for the additional grinding tool includes a first friction wheel at the main grinding spindle and having a groove in its periphery and a second friction wheel extending into the groove with play to either contact one flank of the groove or to be out of contact therewith. The work spindle for the tool being connected with the second friction wheel, and the work spindle being in a bearing housing which is pivoted around an axis perpendicular to the axis of the grinding spindle so that contact between the grinding tool and the spectacle lens brings the friction wheels into engagement to drive the tool to rotate for beveling the periphery of the lens.

9 Claims, 1 Drawing Sheet

ADDITIONAL, FRICTION-WHEEL-DRIVEN GRINDING SPINDLE FOR BEVELLING THE EDGES OF SPECTACLE LENSES ON A SPECTACLE-LENS-EDGING MACHINE

BACKGROUND OF THE INVENTION

The invention relates to an additional, friction-wheel-driven grinding spindle for bevelling the edges of spectacle lenses on a spectacle-lens-edging machine. The machine has two coaxial half-shafts for retaining and rotating a spectacle lens. It has a grinding spindle with an axis parallel to the half-shafts. The spindle can be moved radially and axially, along with the bearing housing that supports the spindle, relative to the half-shafts. The spindle carries a rough grinding and finish grinding wheel for grinding the spectacle lens periphery, and it optionally has a groove for grinding a ridge bevel.

A conical grinding tool arranged on the bearing housing follows the radial and axial movements of the bearing housing relative to the half-shafts supporting the spectacle lens. The tool rotates around an axis extending radially with respect to the spectacle lens. The grinding tool is intended for bevelling the edges of the spectacle lens periphery and is driven by the grinding spindle, via an angular drive which comprises a pair of friction wheels. The angular drive comprises a first friction wheel, which is positioned on a neck of the bearing housing, and a second friction wheel, which is seated on the work spindle, that bears the conical grinding tool and is mounted in a further bearing housing perpendicularly with respect to the grinding spindle.

A spectacle lens-edging machine of the above type is described in U.S. Pat. No. 5,363,597. This machine has proven successful, in particular, for providing grooves or scores in the region of the periphery of the ground-to-shape spectacle lens. For providing grooves or scores, the radial machining tool is moved in a controlled manner both axially and radially with respect to the spectacle lens. This can be carried out purely mechanically or by means of CNC control, wherein the computer also controls the grinding in accordance with a predetermined spectacle lens periphery.

In this known spectacle lens-edging machine, the angular drive is always in drive connection with the grinding spindle. As a result, the work spindle with the machining tool runs at high speed along with the grinding spindle and, accordingly, is subjected to an unnecessarily high degree of wear.

If only a slight bevel is desired to remove the sharp edge which has been produced during the grinding operation from the periphery of the ground-to-shape spectacle lens, then there is no need either for the radial machining tool to run constantly with the grinding spindle or for controlled guidance of the machining tool in the axial direction of the spectacle lens.

U.S. Pat. No. 5,056,270 discloses a spectacle lens-edging machine having two coaxial half-shafts for retaining and rotating a spectacle lens. A grinding spindle is arranged with its axis parallel to the half-shafts. The spindle can be moved radially and axially, with its bearing housing, relative to the half-shafts. The machine has a rough grinding and a finish grinding spindle for grinding the spectacle lens periphery. It has a grinding wheel with a groove for grinding a ridge bevel. The wheel has a grinding tool which rotates around an axis running essentially radially with respect to the spectacle lens and is intended for bevelling the edges of the spectacle lens periphery. The grinding tool is driven by a motor and is arranged in an axially displaceable manner on a retaining means which is itself fastened on a slide. The slide, in turn, can be pivoted around an axis. The slide is mounted on a retaining means which is fastened on the bearing housing for the half-shafts such that it can be displaced parallel to the half-shafts.

The grinding tool provides a safety bevel on the ground periphery spectacle lens. For this purpose, it has its own control means, to cause both the axial displacement of the grinding tool and the axis parallel displacement of the slide in order to bring the grinding tool into engagement with the edges of the spectacle lens periphery. This known apparatus is complicated because, in addition to the control means for the radial and axial movement of the spectacle lens relative to the grinding wheels, it is also necessary to have a further control means for moving the additional grinding tool once grinding of the spectacle lens periphery has been completed.

SUMMARY OF THE INVENTION

In contrast, the object of the invention is to provide a forwardly movable bevelling apparatus on a spectacle lens edging machine, which allows the edges of the ground-to-shape spectacle lens periphery to be bevelled without any risk of the machining tool running during production of the bevels and without that tool being subjected to unnecessary wear.

To achieve this object, the invention proposes a spectacle-lens-edging machine, of the type mentioned in the introduction, with the following features. The spectacle lens edging machine supports a lens for rotation on coaxial half shafts. It has a grinding spindle with an axis extending parallel to the lens shafts. The spindle is movable radially and axially relative to the lens shafts. The spindle has a grinding wheel on it for grinding the periphery of the lens.

An additional friction wheel driven work spindle, which supports a grinding tool for beveling the edges of the spectacle lens, is arranged on the bearing housing for the grinding spindle and therefore moves radially and axially with the spindle. The grinding tool rotates on an axis that extends radially to the axis of the spectacle lens and to the grinding spindle.

An angular drive for the additional grinding tool includes a first friction wheel at the main grinding spindle. The first friction wheel has a groove on its periphery. The angular drive includes a second friction wheel which extends into the groove with play to either contact a flank of the groove or be out of contact with it. The work spindle for the tool is connected with the second friction wheel for being driven. The work spindle is in a bearing housing and that housing is pivoted around an axis perpendicular to the axis of the grinding spindle so that contact pressure between the grinding tool and the spectacle lens brings the friction wheels into engagement to drive the grinding tool to rotate for beveling the periphery of the lens.

The edges of the lens are not bevelled by a profiled grinding wheel which is arranged with its axis parallel to the spectacle lens to be machined. Instead, the grinding tool is oriented radially with respect to the spectacle lens. The grinding tool is guided in an apparatus controlled manner to move in the radial direction relative to the spectacle lens. Guidance in the radial direction is sufficient, whereas, in the axial direction, the tool merely rests against the spectacle lens by having force applied to it.

Since the friction wheel on the work spindle of the tool can only be brought into driving contact with the friction wheel on the main grinding spindle when the spectacle lens rests against the grinding tool, the angular drive is only set in rotation when a ground-to-shape spectacle lens is to be bevelled. The ground-to-shape spectacle lens can have force applied to it, as it rests against the grinding tool, by a spring. But a displacement independent contact force is preferably produced by the movement of the top slide or preferably of the bottom slide in the direction of the grinding tool. This is caused by a motor drive which acts on the top slide or the bottom slide via an adjustable torque clutch. This make it possible for the grinding force for producing the bevel on the ground-to-shape spectacle lens to be set at a different value from that force which is used when the spectacle lens is being ground to shape.

Other features and advantages of the present invention will become apparent from the following description of the invention which refers to the accompanying drawings.

BRIEF DESCRIPTION OF THE DRAWINGS

The invention is explained in more detail below with reference to an exemplary embodiment illustrated in the drawing, in which.

DETAILED DESCRIPTION OF THE INVENTION

Figure 1:
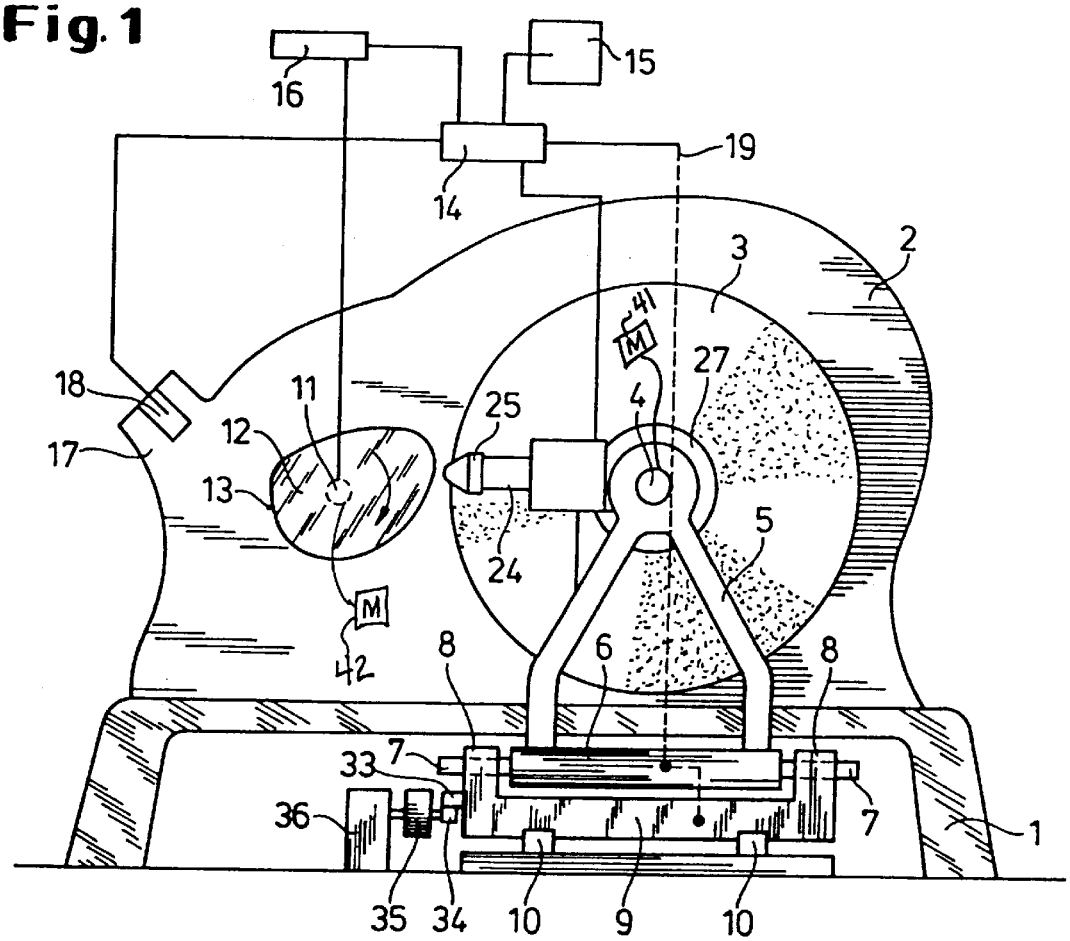
FIG. 1 shows a schematic side view of a spectacle lens edging machine according to the invention.

The spectacle lens edging machine illustrated is a conventional, CNC-controlled spectacle lens edging machine 1 with a housing 2 and a rough grinding and finish grinding wheel 3 which is arranged in the housing 2. The grinding wheel spindle 4 for the wheels 3 is mounted in bearing supports 5 and is set in rotation by a drive motor 41. The bearing supports 5 for the wheel rest on a top slide 6. By means of the guide rods 7, the slide 6 is mounted in extensions 8 of a bottom slide 9 such that the slide can be moved in the direction of a spectacle lens 12. The bottom slide 9 rests on guide rails 10 perpendicular to the guide rods 7 and can be displaced parallel to the grinding spindle 4.

The spectacle lens edging machine has a shaft comprised of two coaxial half-shafts 11, between which a spectacle lens 12 is retained by a suitable known retaining means. The spectacle lens periphery 13 is produced by the rough grinding and finish grinding wheel 3 as the half-shafts 11 are rotated slowly by a drive motor 42. In the process, the quickly rotating rough grinding and finish grinding wheel 3 grinds the spectacle lens periphery 13. The spectacle lens periphery 13 is stored in a desired value memory 15, which is connected to a computer 14. Via a control line 19, the computer 14 activates drives for the slides 6 and 9, of which only one drive 33, 34, 35, 36 for the bottom slide 9 is illustrated. This produces the necessary radial and axial movements of the rough grinding and finish grinding wheel 3 in order to produce the desired spectacle lens periphery 13. The rotation of the half-shafts 11 with the spectacle lens 12 is controlled via an angle sensor 16. A radius and/or contour sensor 18 arranged in a projection 17 of the housing 2 sends data to the computer 14 regarding the spectacle lens periphery 13 achieved and/or the three dimensional curvature thereof.

It is alternatively possible for the half-shafts 11 with the spectacle lens 12 to be moved radially and axially, while the rough grinding and finish grinding wheel 3 merely rotates without shifting radially or axially, or else for the half-shafts 11 with the spectacle lens 12 to be movable radially and the rough grinding and finish grinding wheel 3 to be movable axially, or vice versa.

The grinding spindle 4 projects from a neck 20' of a bearing housing on the bearing support 5. A cylindrical sleeve 27 is fitted on to this bearing neck 20' and is retained by means of a clamping screw (not illustrated). A work spindle 21 is mounted in ball bearings 28 in a carrier element 22 and extends in the radial direction with respect to the axis of the grinding spindle 4. This forms a bearing housing. The work spindle 21 supports a machining tool 25 at one end which is in the form of a conical grinding head 25. A friction wheel 30 at the other end is provided with a rubber ring 29 and engages with play, at right angles, in a groove 32 of a wheel 31 which is on and rotatable with the grinding spindle 4. An extension 23 arranged on the bearing housing 22 is fastened pivotably, by means of a pin 24, on a bearing block 26 on the cylindrical sleeve 27. The pin 24 forms a pivot axis for the bearing housing 22 with the work spindle 21 mounted rotatably therein. As a result, the rubber ring 29 on the friction wheel 30 can optionally be brought into driving contact with one flank or the other of the groove 32 in the friction wheel 31 when a ground-to-shape spectacle lens 12 is moved towards the conical grinding tool 25 in the direction of the arrow A, or else perpendicularly thereto. Depending on the side from which the ground-to-shape spectacle lens 12 is brought into contact with the conical grinding tool 25, the bearing housing 22 tilts in the direction of the double arrow B in the region of the pivot axis forming pin 24. The rotation of the grinding spindle 4 thus only causes the grinding tool 25 to rotate quickly when a ground-to-shape spectacle lens 12 is to be bevelled. It is possible for the front edge and rear edge of the ground-to-shape spectacle lens 12 to be bevelled one after the other.

The grinding tool 25 projects beyond the diameter of the rough grinding and finish grinding wheel 3 to a slight extent. This enables the ground periphery spectacle lens 12 to be brought into the region of the grinding tool 25 and bevelled. During the bevelling operation, the machining tool 25 moves radially with the top slide 6, corresponding to the contour of the periphery 13 of the ground-to-shape spectacle lens 12, as has been described for the operation of grinding the spectacle lens periphery 13. To bevel the edges of the spectacle lens periphery 13, the machine tool 25 is positioned against the edges, but it only touches these edges lightly either under spring pressure or preferably by a force applied by means of a drive device, which is illustrated schematically in FIG. 1.

Figure 2:
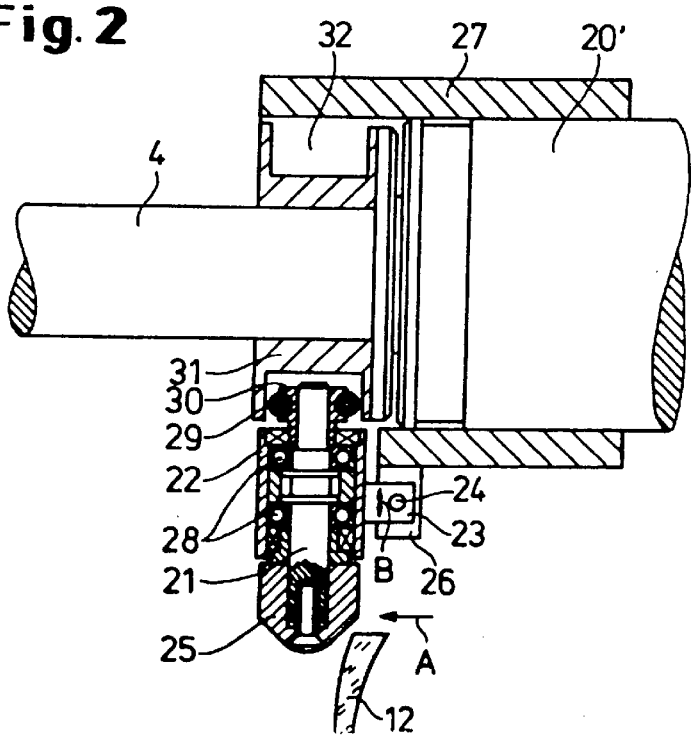
FIG. 2 shows a schematic view of part of the spectacle lens edging machine with a sectional illustration of the angular drive.

A rack 33 is fastened on the bottom slide 9 in which a gear wheel 34 engages. The gear wheel 34 is in drive connection with the drive motor 36 via a magnetic particle clutch 35. The drive motor 36 advances the ground-to-shape spectacle lens 12 in the direction of the arrow A (FIG. 2), by axis parallel displacement of the bottom slide 9, up to the conical grinding tool 25. The grinding pressure is determined by applying a voltage to the magnetic particle clutch 35. The smaller is the voltage applied, the smaller is the torque which can be transmitted by the magnetic-particle clutch 35, and thus also the force by which the spectacle lens 12 rests against the conical grinding tool 25. Tests have shown that a grinding pressure of 3 Newton is sufficient for the conical grinding tool 25 to be driven by the friction wheel 31 which is caused by tilting of the bearing housing 22 and for a sufficient grinding result to be achieved.

The spectacle lens periphery 13 can also be bevelled using a spectacle-lens-edging machine without CNC control, i.e., using copy grinding of a template which is arranged on one of the half-shafts 11 and controlling the radial displacement of the top slide 6, while the axial movement of the bearing support 5 with the rough grinding and finish grinding wheel 3 is provided by a mechanical displacement of the bottom slide 9, e.g. by means of a so-called Panhard rod, and the grinding pressure is provided by a spring.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A spectacle lens edging machine including a friction wheel driven grinding spindle for beveling the edges of the spectacle lens, the machine comprising:

a shaft for supporting and rotating a spectacle lens to be ground;

a grinding spindle having a rotation axis parallel to the axis of the shaft, the shaft and the spindle being relatively movable both radially and axially for grinding the lens, a grinding wheel on the grinding spindle, the grinding wheel being rotated by the grinding spindle so as to grind the spectacle lens periphery;

a grinding tool supported at the grinding spindle for following the radial and axial movement of the spindle relative to the shaft; the grinding tool being supported for rotating on a tool axis extending radially with respect to the axis of the shaft, the grinding tool including a tool element shaped for beveling the edges of the spectacle lens periphery;

an angular drive for driving the grinding tool by rotation of the grinding spindle, the angular drive comprising a first friction wheel which is supported to rotate with the grinding spindle;

a work spindle oriented perpendicular to the grinding spindle, the grinding tool element being on and rotatable with the work spindle;

a second friction wheel on the work spindle and engageable with and disengageable from the first friction wheel;

the work spindle being supported such that the work spindle can be pivoted around an axis perpendicular to the axis of the grinding spindle from a position at which the second friction wheel is out of driving contact with the first friction wheel to a position at which the second friction wheel on the work spindle is moved into driving contact with the first friction wheel on the grinding spindle so as to rotate the work spindle and the tool element to grind the periphery of a lens.

2. The machine of claim 1, further comprising a work spindle bearing housing pivotably mounted around a support axis perpendicular to the axis of the grinding spindle so that force applied to the grinding tool pivots the work spindle bearing housing around the support axis for moving the first and second friction wheels into or out of engagement respectively as the work spindle bearing housing is pivoted.

3. The machine of claim 1, further comprising a grinding spindle bearing housing at the grinding spindle for supporting the grinding spindle; the grinding tool being supported on the grinding spindle bearing housing and being movable along with the grinding spindle bearing housing and relative to the shaft.

4. The machine of claim 1, wherein the shaft comprises coaxial half shafts which cooperate to retain and rotate a spectacle lens.

5. The machine of claim 1, wherein the grinding tool element is conical and tapers narrower in the direction radially toward the shaft for the lens.

6. The machine of claim 1, wherein the first friction wheel has a first periphery with a groove therearound and the groove has opposite spaced apart flanks, the second friction wheel has a second periphery and is so placed that the second periphery extends into the groove in the first friction wheel; the second friction wheel being narrowed with respect to the distance between the flanks of the groove to provide play in the groove for enabling the second friction wheel to selectively be brought into driving contact with either of the flanks of the groove of the first friction wheel to rotate the second friction wheel or be out of contact with both of the flanks of the groove, whereby the first friction wheel does not rotate the second friction wheel or the grinding tool.

7. The machine of claim 1, further comprising means for setting the contact pressure of the spectacle lens against the grinding tool during the beveling operation to a value which is independent to displacement of the grinding spindle and the shaft.

8. The machine of claim 1, further comprising a cross-slide guide for the grinding spindle comprising a first slide for moving the grinding spindle in a radial direction and a second slide for moving the grinding spindle in an axial direction, whereby movement of the slide for moving the grinding spindle in a radial direction moves the grinding tool radially toward and away from the lens.

9. The machine of claim 8, further comprising a motor drive, an adjustable torque clutch on the slide and the clutch is drivable by the motor drive for moving the grinding tool in the radial direction with reference to the lens.

* * * * *